US007819657B2

(12) United States Patent
Molla

(10) Patent No.: US 7,819,657 B2
(45) Date of Patent: Oct. 26, 2010

(54) GAS BURNER WITH ONLY AN INTERNAL FLAME

(75) Inventor: Jean-Claude Molla, Beauchamp (FR)

(73) Assignee: GDF Suez, Paris (FR)

( * ) Notice: Subject to any disclaimer, the term of this patent is extended or adjusted under 35 U.S.C. 154(b) by 1305 days.

(21) Appl. No.: 11/228,320

(22) Filed: Sep. 19, 2005

(65) Prior Publication Data

US 2006/0063119 A1 Mar. 23, 2006

(30) Foreign Application Priority Data

Sep. 17, 2004 (FR) ..... 04 09878

(51) Int. Cl.
*F23D 14/62* (2006.01)

(52) U.S. Cl. ..... 431/354; 431/284; 126/39 E

(58) Field of Classification Search ..... 431/354, 431/284; 126/39 E
See application file for complete search history.

(56) References Cited

U.S. PATENT DOCUMENTS

2004/0195399 A1* 10/2004 Molla ..... 239/594
2004/0234915 A1* 11/2004 Koch et al. ..... 431/278

* cited by examiner

*Primary Examiner*—Alfred Basichas
(74) *Attorney, Agent, or Firm*—Jacobson Holman PLLC

(57) ABSTRACT

A burner has a pot provided with an inlet for a gas mixture to be burned and a cap that sits on top of the pot. The pot and the cap define both a central zone for combustion of the gas mixture, and a peripheral chamber that extends around the central zone and communicates with the gas inlet. A plurality of passageways allow the gas mixture to flow from the peripheral chamber into the central zone. A deflector separates, in a non-leaktight manner, the chamber into a lower subchamber, located substantially in the extension of the inlet, and an upper subchamber adjacent said passageways.

16 Claims, 2 Drawing Sheets

GAS BURNER WITH ONLY AN INTERNAL FLAME

BACKGROUND OF THE INVENTION

1. Field of Invention

The present invention relates to an improved gas burner with only an internal flame.

2. Description of the Prior Art

Patent application FR 02/16401 teaches a gas burner with only an internal flame, of the type comprising:

a pot provided with an inlet for the mixture to be burnt; and a cap that sits on top of said pot, said pot and said cap defining:

a central zone for combustion of said mixture to be burnt; and a peripheral chamber that extends around said central zone and communicates with said inlet, said burner further comprising:

a plurality of passageways for making said mixture flow from said peripheral chamber toward said central zone; and a deflector that extends into at least part of said chamber.

Although it does have a number of indubitable advantages, this burner is not entirely satisfactory.

This is because it has been observed that, when in use, the flame is not distributed uniformly around the central zone (or "chimney") and that it is quite unstable, that is to say its flow fluctuates over the course of time.

SUMMARY OF THE INVENTION

The object of the present invention is to improve this burner of the prior art so as to eliminate the abovementioned drawbacks.

This object is achieved with a gas burner with only an internal flame, of the type comprising:

a pot provided with an inlet for the mixture to be burnt; and a cap that sits on top of said pot, said pot and said cap defining:

a central zone for combustion of said mixture to be burnt; and a peripheral chamber that extends around said central zone and communicates with said inlet, said burner further comprising:

a plurality of passageways for making said mixture flow from said peripheral chamber toward said central zone; and a deflector that extends into at least part of said chamber, this deflector being placed so as to separate said chamber into a lower subchamber, located approximately in the extension of said inlet, and into an upper subchamber adjacent said passageways, and to provide a passage with the radially external wall of said peripheral chamber.

In this burner according to the invention, the mixture to be burnt arrives in the lower subchamber, filling the latter before escaping into the upper subchamber and then into the passageways opening into the central zone ("chimney") of the burner.

By filling the lower subchamber it is possible to ensure good distribution and good homogenization of the mixture to be burnt around the central zone before this mixture penetrates into this zone.

The fact that the passage between the lower and upper subchambers is located against the outer wall of the peripheral chamber, that is to say it is offset radially relative to the passageways that open into the central zone, prevents the mixture to be burnt from reaching these passageways directly, and therefore contributes to this mixture being well distributed and well homogenized.

In addition, the prior filling of the lower subchamber with the mixture to be burnt means that there is a continuous flow of this mixture into the upper subchamber and then into the passageways that open into the central zone, thereby making it possible in fine to obtain excellent combustion stability.

In accordance with other features of the burner according to the invention:

said deflector extends over the entire perimeter of said peripheral chamber;

said central zone is circular and said deflector is annular;

said deflector is fastened to a circular shoulder of said pot;

said inlet opens into said peripheral chamber beneath said deflector;

said inlet penetrates slightly into said peripheral chamber;

the cross section of said peripheral chamber decreases upon going away from said inlet;

said decrease stems from a progressively increasing rise in the bottom of said pot upon going away from said inlet;

said decrease stems from an offset between the axes of the radially inner and outer walls of said peripheral chamber;

said cap includes a skirt connected to a ring provided with radial slots;

the radial inner and outer walls of said ring are inscribed on inverted cones, the apexes of which are above and below the burner respectively; and said burner includes a removable casing that rests on said skirt via supports.

BRIEF DESCRIPTION OF THE DRAWINGS

Other features and advantages of the present invention will result from the description that follows and from the appended drawings, in which.

DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
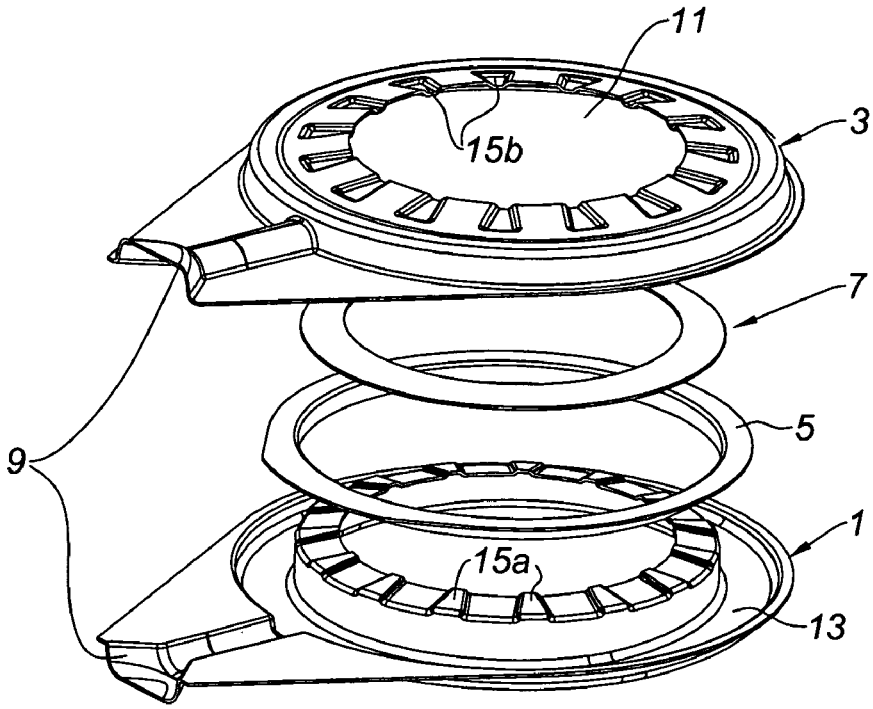
FIG. 1 is an exploded perspective view of a burner according to the invention.

Referring now to FIG. 1, this shows, according to a first embodiment preferably for domestic use, that the gas burner according to the invention comprises a pot 1, a cap 3, an annular deflector 5 and an annular insert plate 7.

The pot 1 and the cap 3 are shaped so that, once assembled, they define a convergent-divergent duct or venturi duct 9.

In the example shown, the pot 1 and the cap 3 have a generally circular shape, with the exception of the zone that defines the venturi duct 9.

This pot and this cap are also shaped so as to define, when they are assembled, on the one hand a central combustion zone 11 and, on the other hand, a peripheral chamber 13 that extends around the central zone 11 and communicates with the venturi duct 9.

It will also be noted that the pot 1 and the cap 3 each have a plurality of respective bosses 15*a*, 15*b* distributed around the central zone 11.

Figure 3:
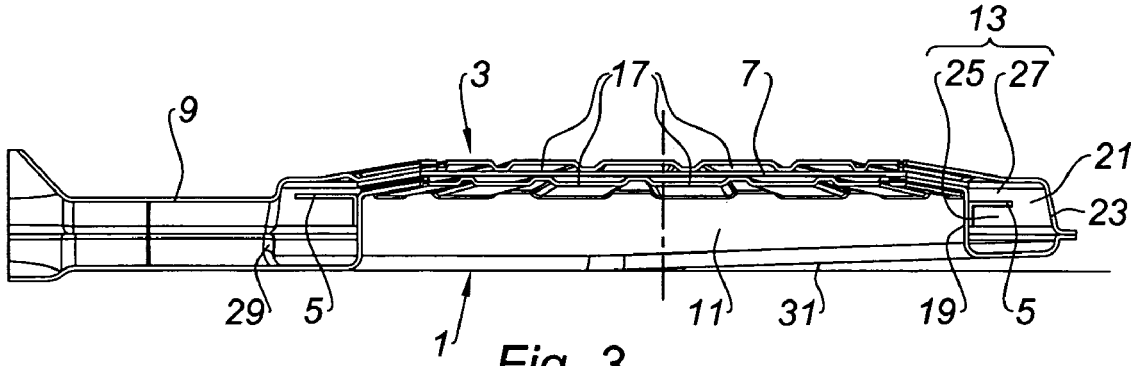
FIG. 3 is an axial sectional view of this burner.
Figure 4:
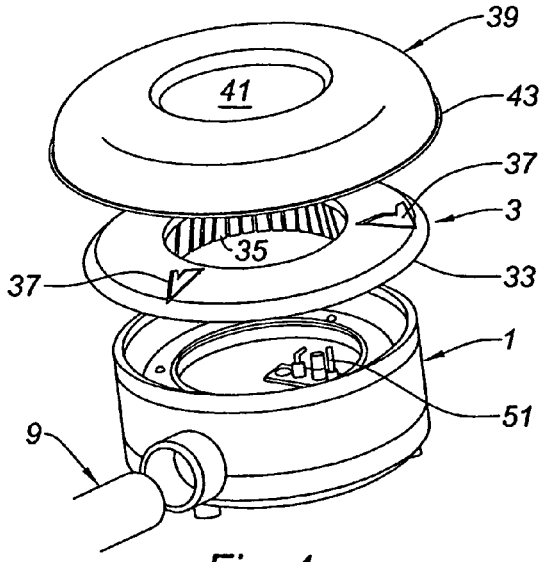
FIG. 4 is an exploded perspective view of another embodiment of the burner according to the invention.
Figure 6:
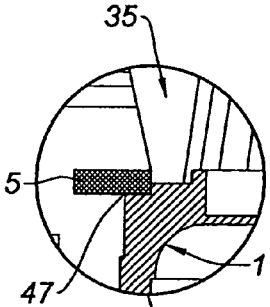
FIGS. 6 and 7 show details of FIG. 5.

These bosses are arranged so as to sandwich the annular insert plate 7 once the burner is assembled, and thus to define a plurality of passageways 17 for bringing the peripheral chamber 13 into communication with the central zone 11 (see FIG. 3).

According to possible alternative embodiments (not shown), these passageways 17 could be formed only in the pot 1, or else only in the cap 3, or else in an intermediate component that would be placed between this pot and this cap.

As may be seen in particular in FIG. 3, the annular deflector 5 extends into the peripheral chamber 13 once the cap 3 is mounted on the pot 1.

In the example shown, this deflector has a cross section in the form of an L, one leg of which is fastened to the radially inner wall 19 of the peripheral chamber 13, on the pot 1, and the other leg of which is approximately parallel to the general plane of this pot.

This deflector 5 therefore makes, with the radially outer wall 23 of the peripheral chamber 13, a passage 21.

Preferably, the radial width of the passage 21 is approximately equal to half the radial width of the peripheral chamber 13.

As may therefore be understood, the deflector 5 thus separates the peripheral chamber 13 into two subchambers, namely a lower subchamber 25 that extends beneath this deflector and an upper subchamber 27 that extends above this deflector.

Of course, it will be understood that the terms "lower" and "upper" mean relative to the normal position in which the burner is used, that is to say a position in which the pot 1 is underneath and the cap 3 is on the top.

As is visible in particular in FIG. 3, the lower subchamber 25 communicates with the outlet 29 of the venturi duct 9, and the upper subchamber 27 communicates with the passageways 17.

In the example shown, the pot 1 and the cap 3 have an approximately circular shape, so that the deflector 5 itself has an approximately annular shape.

This example is in no way limiting, and a deflector 5 of any shape, matched to that of the pot 1 and the cap 3, could be envisaged.

Thus, it would also be possible to envisage another embodiment in which the deflector 5, instead of going completely around the peripheral chamber 13, extends only around part of this chamber.

Another embodiment could also be envisaged in which the deflector 5 extends from the radially inner wall 19 to the radially outer wall 23, and includes a plurality of orifices providing communication between the lower subchamber 25 and the upper subchamber 27.

Preferably, as shown, the inlet 29 opens into the peripheral chamber 13 beneath the deflector 5.

Provision may also be made, again as shown in FIG. 3, for the bottom 31 of the pot 1 to progressively rise slightly upon going away from the inlet 29, thus reducing the cross section of the lower subchamber 25 when going away from this inlet.

In the embodiment in FIGS. 4 to 8, preferably intended for professional use (for communities, restaurants, etc.), the cap 3 includes a skirt 33 that bears on the pot 1 and, under this skirt, a ring 35 provided all around its periphery with the passageways 17, the passageways being configured in this embodiment of the invention as slots.

These slots define the passageways 17 between the upper subchamber 27 and the central zone for combustion 11, the central zone also sometimes being referred to as a chimney.

Preferably, as may be seen in FIG. 5, the radially inner and outer walls of the ring 35 are inscribed on inverted cones, the apexes of which are above and below the burner respectively.

It will also be noted that three supports 37 are placed on the skirt 33, these being arranged at 120° to one another.

Resting on these supports 37 is a casing 39 that has, at its center, an orifice 41 of diameter approximately equal to that of the central zone 11 and, around its periphery, a bent-over part 43 that defines a peripheral passage 45 toward the ring 35.

A deflector 5 of annular shape, which separates the lower subchamber 25 from the upper subchamber 27, is fastened (by hammering or crimping or welding or with bolts) to a circular shoulder 47 of the pot 1.

Figure 7:
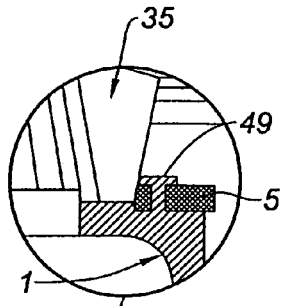

FIG. 7 illustrates the particular case in which this deflector 5 is fastened onto the shoulder 47 by hammering, a hammered lug 49 being visible in this figure.

It will be noted that the convergent-divergent duct 9 preferably penetrates slightly into the lower subchamber 25.

It will also be noted that the axes A and A' of the respective inner and outer walls of the peripheral chamber 13 are preferably slightly offset one with respect to the other, so that, in its part diametrically opposite the duct 9, this chamber becomes radially narrower.

The way in which the gas burner according to the invention works and its advantages result directly from the foregoing description.

Figure 2:
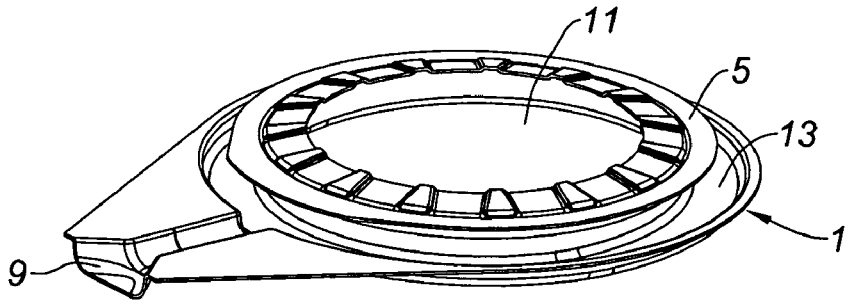
FIG. 2 is a perspective view of the pot of this burner.

Consider firstly the first embodiment ("domestic" burner: FIGS. 1 to 3).

It should be imagined that, in operation, a gas injector is placed at the inlet of the venturi duct 9.

The function of this duct is to ensure that the gas output by the injector is intimately mixed with the ambient air.

What is obtained at the outlet 29 of this duct is a combustible gas/ambient air mixture.

This mixture flows in its entirety beneath the deflector 5, and thus starts by filling the lower subchamber 25.

Once this filling has been completed, the mixture to be burnt follows the passage 21 all around the periphery of the pot 1, then passes through the upper subchamber 27 and the passageways 17, thus finally flowing into the central zone 11 where it is ignited and burnt, thus releasing the necessary heat.

As may be understood in the light of the foregoing, the role of the deflector 5 is to ensure good distribution of the mixture to be burnt throughout the peripheral chamber 13 before this mixture reaches the passageways 17.

It is therefore possible to obtain good distribution of the flame around the central zone 11.

In addition, by prefilling the lower subchamber 25 with the mixture to be burnt it is possible to ensure that there is a continuous flow of this mixture into the upper subchamber 27 and then into the passageways 17, thereby achieving excellent combustion stability.

It will be noted that the fact that the inlet 29 opens beneath the deflector 5 makes it possible to ensure that all of the mixture to be burnt fills the lower subchamber 25 before migrating into the upper subchamber 27.

It will be noted that the fact that the cross section of the peripheral chamber 13 decreases on going away from the inlet 29 makes it possible to create a pressure drop between that part of said chamber which is located near the inlet 29 and that part of said chamber which is located on the opposite side to this inlet.

This makes it possible to rebalance the streams of mixture to be burnt in these two zones and thus to optimize the distribution of this mixture throughout the chamber 13.

The principle of operation of the burner according to the second embodiment ("professional" burner: FIGS. 4 to 8) is similar to that of the burner according to the first embodiment: the mixture to be burnt flows into the lower subchamber 25, starts by filling the latter, then follows the passage 21 all around the periphery of the pot 1, then passes through the upper subchamber 27 and the passageways 17, thus finally flowing into the central zone 11 where it is ignited and burns, thus releasing the necessary heat.

It will be noted that the offset of the axes A, A' of the inner and outer walls of the peripheral chamber 13 makes it possible to free the space in the zone 53 (see FIG. 5) of the central zone 11 which lies radially opposite the duct 9.

This freed space facilitates the installation of a pilot 51 (see FIG. 4), an ignition electrode or any other flame monitoring device, such as thermocouples.

Furthermore, the radial narrowing of the peripheral chamber 13 resulting from this axial offset makes it possible to produce the same pressure drop effect as in the previous embodiment.

The fact of mounting the deflector 5 on a circular shoulder of the pot 1 ensures that this deflector 5 is perfectly centered with respect to the central zone 11 and ensures that this deflector 5 is very stable.

Fastening the deflector 5 onto the pot 1 by hammering is one particularly simple solution, three lugs 49 arranged at approximately 120° being sufficient.

The fact that the duct 9 partially penetrates into the peripheral chamber 13 makes it possible to prevent the flashback that can arise in particular when turning off the gas tap.

Figure 5:
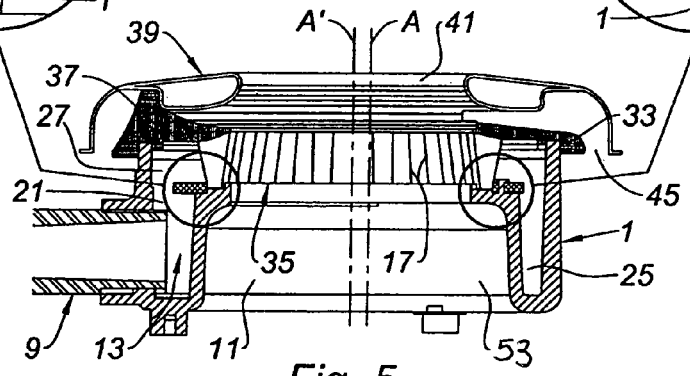
FIG. 5 is an axial sectional view of this other burner.
Figure 8:
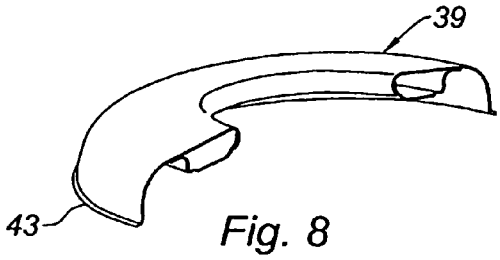
FIG. 8 is a partial view in perspective of an element that forms part of the burner of FIGS. 4 to 7.

The fact of providing for the radially inner and outer walls of the ring 35 to be inscribed on inverted cones, as may be seen in FIG. 5, makes it possible to increase the radial dimensions of the passageways 17, especially in their upper parts, and thus to favor laminar flow of the mixture to be burnt, especially when the burner is operating at low burn rate.

The supports 37 placed on the skirt 33 of the cap 3 are used to keep the casing 39 away from this cap and thus to establish the peripheral passage 45 between the ring 35 and the outside.

This peripheral passage 45 allows an additional inflow of air into the flames emerging in the central zone 11 via the passageways 17, and thus contributes to the proper combustion of the mixture to be burnt and, in fine, to improving the energy efficiency of the burner.

The casing 39 is removable, and it also helps to protect the burner from any splashes.

In addition, if it is fitted with suitable devices, it helps to support saucepans placed on top of the burner.

Of course, the present invention is not limited to the embodiments described, shown and provided by way of non-limiting illustration.

Thus, for example, it would be conceivable, in the situation in which the upper part of the duct 9 opens into the chamber 13 at a height above that of the deflector 5, to provide a boss in this upper duct, making it possible for the stream of mixture to be burnt to be directed beneath the deflector 5.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A gas burner with only an internal flame that converges toward a heat concentration point, comprising:

a pot provided with an inlet for a mixture to be burned;

a cap that sits on top of said pot, said pot and said cap defining a central zone for combustion of said mixture to be burned, and a peripheral chamber that extends around said central zone and communicates with said inlet;

a plurality of passageways through which said mixture flows from said peripheral chamber toward said central zone; and a deflector that extends into at least a part of said peripheral chamber, said inlet opening into said peripheral chamber beneath said deflector, and said deflector being placed so as to separate said chamber into a lower subchamber, located approximately in an extension of said inlet, and into an upper subchamber adjacent said passageways, said deflector defining with a radially external wall of said peripheral chamber a passage between said lower subchamber and said upper subchamber, said deflector being configured such that said mixture to be burned flows into said lower subchamber, fills said lower subchamber, flows through said passage, flows through said upper subchamber, flows through said passageways, and flows into said central zone.

2. The burner as claimed in claim 1, wherein said deflector extends over an entire perimeter of said peripheral chamber.

3. The burner as claimed in claim 1, wherein said central zone is circular and said deflector is annular.

4. The burner as claimed in claim 1, wherein said deflector is fastened to a circular shoulder of said pot.

5. The burner as claimed in claim 1, wherein a radial width of said passage is approximately equal to half a radial width of said peripheral chamber.

6. The burner as claimed in claim 1, wherein said inlet penetrates slightly minimally into said peripheral chamber.

7. The burner as claimed in claim 1, wherein a cross section of said peripheral chamber decreases with distance traveled from said inlet.

8. The burner as claimed in claim 7, wherein a bottom of said pot has a progressively increasing rise therein with said distance traveled from said inlet.

9. The burner as claimed in claim 7, wherein axes of radially inner and outer walls of said peripheral chamber are offset from each other.

10. The burner as claimed in claim 1, wherein said cap includes a skirt connected to a ring provided with radial slots.

11. The burner as claimed in claim 10, wherein radial inner and outer walls of said ring are inscribed on inverted cones, with apexes of said inverted cones being above and below the burner, respectively.

12. The burner as claimed in claim 10, further comprising a removable casing that rests on said skirt via a plurality of supports.

13. A gas burner for an internal flame that converges toward a heat concentration point, comprising:

a pot provided with an inlet for a combustible gas;

a cap positioned above said pot;

a central combustion zone defined by said pot and said cap;

a peripheral chamber extending around said central combustion zone and communicating with said gas inlet;

a deflector (i) extending peripherally outward from said pot and into at least a portion of said peripheral chamber, (ii) defining said peripheral chamber to include a lower subchamber and an upper subchamber, and (iii) defining with a radially external wall of said peripheral chamber a passage between said lower subchamber and said upper subchamber; and a plurality of passageways disposed adjacent said upper subchamber through which said gas flows from said upper subchamber to said central combustion zone, said gas inlet extending into said lower subchamber a distance from said external wall of the peripheral chamber, and said deflector being configured to route said gas into and fill said lower subchamber, through said passage, through said upper subchamber, through said passageways, and into said central combustion zone.

14. The gas burner according to claim 13, wherein said deflector extends outward from an entire circumference of said pot.

15. The gas burner according to claim 13, wherein said cap includes a skirt connected to a ring provided with said passageways.

16. The gas burner according to claim 15, wherein said passageways are configured as radial slots.

* * * * *